United States Patent [19]

Shekel et al.

[11] 4,377,317

[45] Mar. 22, 1983

[54] ADAPTER FOR CONNECTING AUXILIARY CABLE TO SIDE TERMINAL BATTERY

[75] Inventors: Joseph Shekel, New York; Joseph DeStefano, Carle Place, both of N.Y.

[73] Assignee: Auto-Line Manufacturing Corp., Copaigue, N.Y.

[21] Appl. No.: 161,398

[22] Filed: Jun. 27, 1980

[51] Int. Cl.[3] ..... H01R 11/00

[52] U.S. Cl. ..... 339/29 B; 339/31 R; 429/121

[58] Field of Search ..... 339/28 R, 28 B, 29 R, 339/29 B, 31, 224, 228, 229, 230; 429/121, 179

[56] References Cited

U.S. PATENT DOCUMENTS 1,821,443 9/1931 Mohr ..... 339/257
3,605,065 9/1971 Shannon ..... 339/28
3,745,516 7/1973 Lieberman ..... 339/228

*Primary Examiner*—Joseph H. McGlynn
*Assistant Examiner*—Frank H. McKenzie, Jr.
*Attorney, Agent, or Firm*—Auslander, Thomas & Morrison

[57] ABSTRACT

A side terminal battery adapter for connecting auxiliary cables to a side terminal of a side terminal battery includes resiliently urged opposed clamp halves adapted for fitting over and gripping the terminal. A gripping surface on the adapter permits connection of the auxiliary cables thereto using conventional gripping jaws. Alternatively, the adapter may be pivotably integrated with the gripping jaws of the auxiliary cables and retained in a selectable angular orientation with respect thereto by interengagement of circularly positioned teeth on the adapter and on the gripping jaws.

7 Claims, 5 Drawing Figures

ADAPTER FOR CONNECTING AUXILIARY CABLE TO SIDE TERMINAL BATTERY

BACKGROUND OF THE INVENTION

The present invention relates to auxiliary connectors for connecting auxiliary cables to battery terminals and more particularly to adapters for permitting connection of auxiliary connectors to side-terminal batteries.

In the past, conventional batteries such as, for example, lead-acid batteries for use in motor vehicles, included terminal posts projecting upward from the top of the battery. Such terminal posts were convenient for clamping or otherwise attaching booster or charging auxiliary cables employing clamp type auxiliary connectors having a pair of opposed resiliently urged jaws such as shown in U.S. Pat. Nos. 4,145,648 and 4,163,134.

More recently, side-terminal batteries have become available in which, instead of having terminal posts projecting upward where they can be reached for connection of auxiliary connectors, such batteries have terminal bolts screwed into threaded positive and negative terminal receptacles on the side walls of the battery. The receptacles project, at the most, only slightly beyond the side wall of the battery, thus making it difficult or impossible to engage side battery terminals with traditional gripping jaws of auxiliary connectors. This difficulty is further compounded by the fact that most vehicle batteries are retained in a metallic battery container having close clearance to the side of the battery and making it difficult or impossible to obtain access for the attachment of the clamping jaws of an auxiliary connector.

In order to attempt to overcome this difficulty, an auxiliary clamp for side-battery terminals has been disclosed in U.S. Pat. No. 3,745,516 which has one end adapted to engage a side-battery terminal and a second end projecting above the battery upon which conventional gripping jaws of an auxiliary connector may be clamped. The disclosed device has a disadvantage that it depends upon spring-back of relatively stiff material for its clamping action. The clamping jaws of such an adapter may become deformed either to produce too loose a fit for a satisfactory mechanical and electrical connection to the side terminal or too tight a fit to prevent connection thereto. Furthermore, in a sense, such adapter is a small free item, it is easily misplaced under conditions normal for storage of battery cables when not in use.

SUMMARY OF THE INVENTION

It is an object of the present invention to provide an adapter for an auxiliary connector for permitting connection of the auxiliary connector to side-terminal batteries.

It is a further object of the invention to provide an adapter for an auxiliary connector having a resiliently urged means for grasping a side terminal of a side terminal battery and permitting connection of an auxiliary connector thereto.

It is a further object of the invention to provide an adapter for a side terminal battery integrated with one jaw of an auxiliary connector wherein interengagement of teeth of the jaw including the adapter with corresponding teeth of a second jaw of the auxiliary connector permit retaining the adapter in a plurality of preselected angular positions with respect to an axis of the auxiliary connector.

According to an aspect of the invention, there is provided an adapter for connecting an auxiliary cable to a side terminal of a side terminal battery, the side terminal having a head portion with a circumferential groove therein, the adapter comprising a metallic member, a first clamp half affixed to the metallic member, a first inner contour on the first clamp half having a shape and thickness adapted for fitting within a first portion of the circumferential groove at a first side of the side terminal, a second clamp half disposed opposed to the first clamp half, a second inner contour on the second clamp half opposed to the first inner contour and having a shape and thickness adapted for fitting within a second portion of the circumferential groove at a second side of the side terminal which is substantially opposite the first side, means for pivoting the second clamp half to permit motion of the second inner contour toward and away from the first inner contour, resilient means for urging the second clamp half about the means for pivoting toward the first clamp half, at least one camming surface on an outer end of at least the second clamp half, the camming surface being adapted for contacting the circumferential groove and for pivoting the second inner contour away from the first inner contour when the camming surface is pressed onto the cimcumferential groove whereby the first and second inner contours are opened to a dimension sufficient for entry of the circumferential groove therebetween, the resilient means being effective to clamp the first and second inner contours in the circumferential groove about the side terminal whereby mechanical and electrical connection between the adapter and the side terminal is achieved, and means for mechanically and electrically connecting the auxiliary cable to the adapter whereby mechanical and electrical connection between the side terminal and the auxiliary cable is achieved through the adapter.

According to a feature of the invention, there is provided an auxiliary connector for connecting an auxiliary cable to a battery terminal comprising first and second mutually pivoted member having first and second opposed jaws at a first end of each thereof, the auxiliary cable being attached to a second end of one of the mutually pivoted member, the first and second jaws having first and second sets of opposed teeth respectively thereon, the first set of teeth being disposed along a portion of a first circle, the second jaw including an adapter, the adapter including the second set of teeth disposed along a portion of a second circle, means for pivoting the adapter about a center of the second circle, the first and second sets of teeth being adapted for mutual interengagement therebetween at a plurality of rotational positions of the adapter about the center of the second circle, whereby the adapter may be locked into a selectable one of the plurality of rotational positions, a metallic plate member on the adapter, a first clamp half affixed to an end of the plate member remote from the second set of teeth, a second clamp half opposed to the first clamp half, means for pivoting a first end of the second clamp half to the plate member, resilient means for urging a second end of the second clamp half toward the first clamp half, a first inner contour on the first clamp half facing the second clamp half, a second inner contour on the second clamp half facing the first clamp half and opposed to the first inner contour, a camming surface on the second clamp half effective to rotate the second end of the second clamp half away from the first clamp half when the camming surface is pressed against a battery terminal of the side terminal type whereby the first and second clamp halves are opened to admit the side terminal between the first and second inner contours for gripping thereof when the adapter is in at least one of the plurality of rotational positions, and the first and second sets of teeth on the first and second jaws respectively being effective to grip opposed sides of a battery terminal of the top terminal type when the adapter is in at least a second of the plurality of rotational positions.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
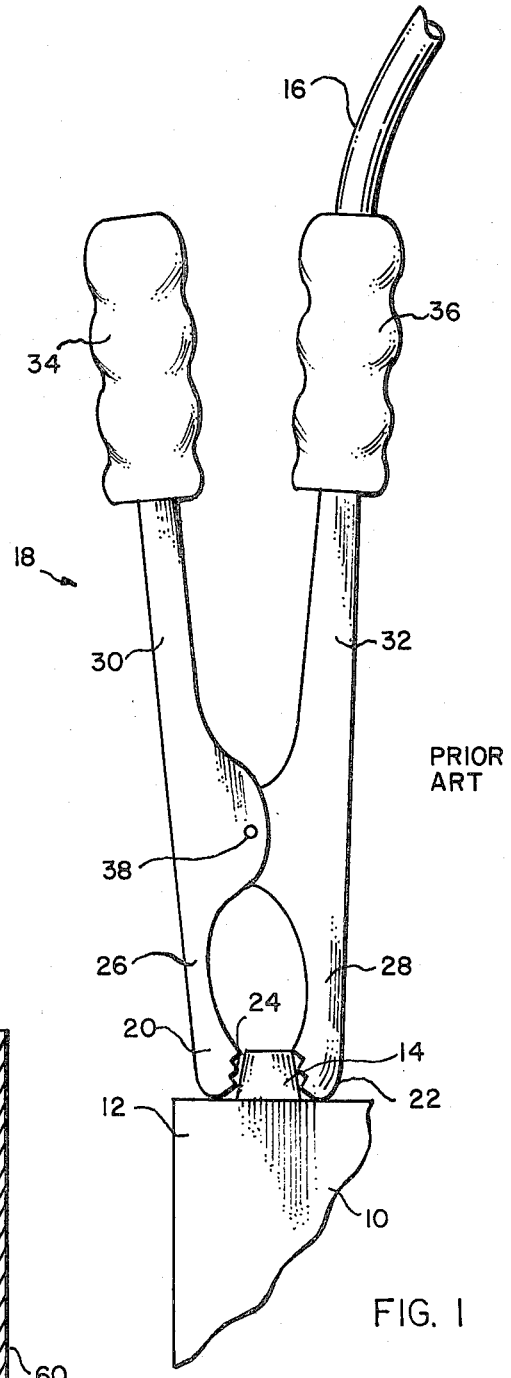
FIG. 1 is a side elevation showing a portion of a top terminal battery to which is attached an auxiliary connector of an auxiliary cable.

Before beginning a description of the present invention, a brief discussion of conventional auxiliary battery cable connectors usable with conventional top terminal batteries will be given with reference to FIG. 1.

A conventional top terminal battery 10 includes a case 12, usually of insulating material. A positive or negative battery terminal 14 protrudes upward from the top of top terminal battery 10 to provide a means for connecting a conventional clamp-type battery cable connector (not shown). When it is desired to provide auxiliary power to, or receive auxiliary power from top terminal battery 10, an auxiliary cable 16 may be electrically and mechanically connected to battery terminal 14 using an auxiliary connector 18.

Auxiliary connector 18 includes a pair of opposed jaws 20 and 22 which may optionally have serrated, tooth-like facing surfaces 24 attached to lower legs 26 and 28. Upper legs 30 and 32, preferably integral with lower legs 26 and 28, respectively, form pliers-like handles for manipulating auxiliary connector 18 in attaching it to battery terminal 14. Insulating hand grips 34 and 36 may optionally be provided on upper legs 30 and 32. The assembly consisting of lower leg 26 and upper leg 30 is pivoted to the assembly consisting of lower leg 28 and upper leg 32 at a pivot 38. A resilient device, conveniently a spring (not shown) is provided for urging jaws 20 and 22 toward each other and upper legs 30 and 32 away from each other so that serrated surfaces 24 may form mechanical and electrical contact with battery terminal 14.

Figure 2:
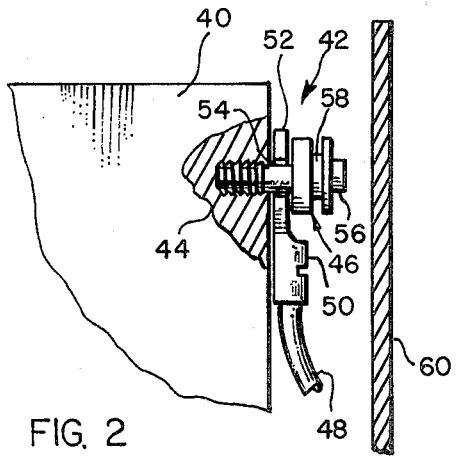
FIG. 2 is a side elevation of a side terminal battery showing details of the side terminal with a battery cable attached thereto.

A side-terminal battery, such as battery 40 shown in FIG. 2, presents difficulties in using the auxiliary connector 18 of FIG. 1. Instead of having a top battery terminal, such as 14 in FIG. 1, side terminal battery 40 has a side terminal 42 extending from the side of battery 40.

Side terminal 42 includes a bolt portion 44 and a head portion 46. A positive or negative battery cable 48 includes an end terminal 50 having a washer-like connector 52 with a through-hole 54 therethrough.

End terminal 50 is firmly connected to battery 40 when bolt portion 44 of side terminal 42 is passed through through-hole 54 and head portion 46 is tightened against it, thus making firm electrical and mechanical contact between end terminal 50 and battery 40. An outer portion 56 of side terminal 42 may be provided with hexagonal or other flat surfaces to enable attachment of a wrench (not shown) for tightening side terminal 42 into battery 40. A circumferential groove 58 may be included in head portion 46.

Side-terminal battery 40 may be installed in a battery case having a metallic wall 60 closely adjacent side terminal 42. Alternatively, metallic wall 60 may comprise a portion of the engine compartment or other metallic structure of the vehicle. As shown in FIG. 2, the clearance between side terminal 42 and metallic wall 60 is insufficient to permit direct connection of jaws 20 and 22 of an auxiliary connector 18 as illustrated in FIG. 1.

Figure 3:
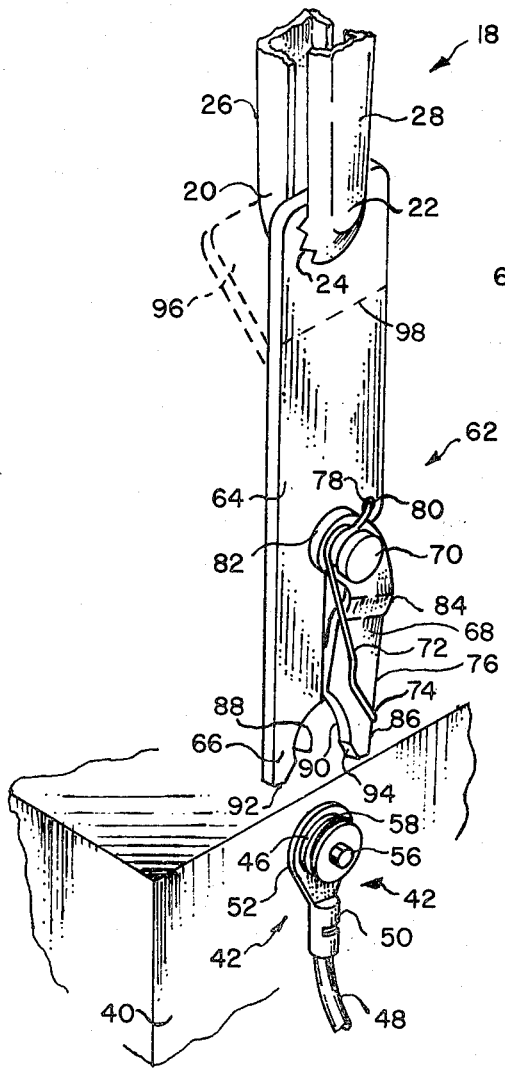
FIG. 3 is a perspective view of a side terminal battery and an adapter according to the present invention in position to be clamped over the side terminal.

In order to permit connection of auxiliary cables to side terminal 42 in the limited clearance space provided, an adapter 62, shown in FIG. 3, may be attached to side terminal 42 and jaws 20 and 22 of auxiliary connector 18 may be attached to adapter 62.

Adapter 62 includes a plate 64 having a fixed clamp half 66 at the lower end thereof. A pivoted clamp half 68 is pivotally attached to plate 64 by a pin 70 in a position opposing fixed clamp half 66. A resilient member such as a spring 72 resiliently urges pivoted clamp half 68 toward fixed clamp half 66. Spring 72 may optionally include a first end 74 bent at right angles and engaging the outer edge 76 of pivoted clamp half 68. A second end 78 of spring 72 may also be bent at right angles to pass through a hole 80 in plate 64. Spring 72 may execute one or more turns (not shown) about pin 70 to enhance the resilient urging thereof.

An upper portion 82 of pivoted clamp half 68, through which pin 70 passes, is preferably in stabilizing abutment with the surface of plate 64. Pivoted clamp half 68 is preferably bent, such as along a bend line 84 to place a lower portion 86 of pivoted clamp half 68 coplanar with fixed clamp half 66.

An inner semi-circular contour 88 on fixed clamp half 66 opposes a similarly shaped inner semi-circular contour 90 on pivoted clamp half 68. Fixed clamp half 66 and pivoted clamp half 68 have inwardly sloping camming surfaces 92 and 94, respectively, at the lower ends thereof.

Fixed clamp half 66 and pivoted clamp half 68 have a thickness which permits them to fit into circumferential groove 58 in side terminal 42. In order to attach adapter 62 to side terminal 42, camming surfaces 92 and 94 are pressed into circumferential groove 58. As adapter 62 is pressed downward, camming surfaces 92 and 94 tend to rotate pivot clamp half 68 in the couterclockwise direction about pin 70 until the opening defined by circumferential contours 88 and 90 enclose circumferential groove 58. Spring 72 thereupon holds side terminal 42 in a locking embrace within semi-circular contours 88 and 90.

With adapter 62 thus installed on side terminal 42, plate 64 of adapter 62 may stand above the region of close clearance between side terminal 42 and metallic wall 60 (FIG. 2). This permits attachment of jaws 20 and 22 of a conventional auxiliary connector 18 to the upper end of plate 64.

Alternatively, in order to avoid interference between auxiliary connector 18 and other structure in a vehicle, an upper end 96, shown in dashed line, of plate 64 may be bent at any convenient angle along a bend line 98. In this way, when auxiliary connector 18 is clamped to upper end 96, its length is caused to lie more nearly parallel to the top of side battery terminal 40.

A second embodiment of the invention is described with reference to FIGS. 4 and 5. An adapter 62' is shown integrated with lower leg 28' so that the resulting auxiliary connector 18 may be used interchangeably on either top terminal battery 10 (FIG. 1) or side terminal batteries 40 (FIGS. 2 and 3).

The end of jaw 20 describes a semi-circle and the teeth of serrated surface 24 about the forward perimeter of jaw 20 form a semi-circle. The end of adapter 62' remote from clamp halves 66 and 68 also defines a semi-circle and has a semi-circular set of teeth defining a serrated surface 24' thereon disposed facing and aligned with serrated surface 24 on jaw 20. The shape and spacing of teeth in serrated surfaces 24 and 24' permit interengagement of teeth on serrated surfaces 24 and 24' with spaces in the opposed serrated surface.

Figure 4:
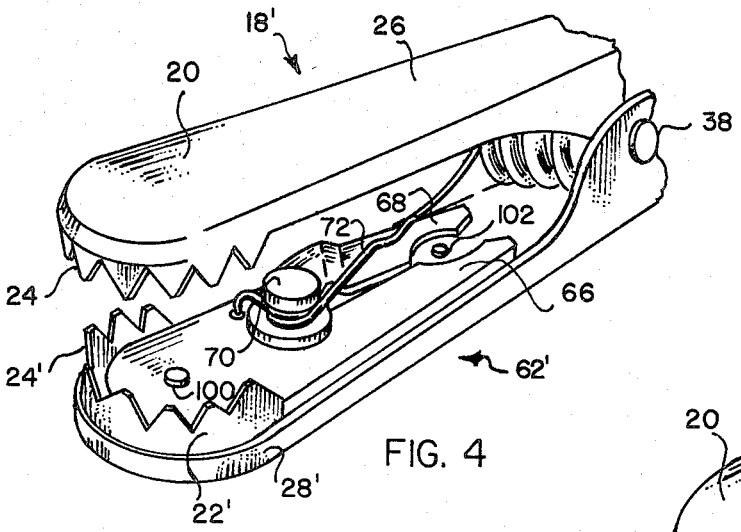
FIG. 4 is a perspective view of a second embodiment of the invention having an adapter similar to FIG. 3 integrated in one jaw of an auxiliary connector.
Figure 5:
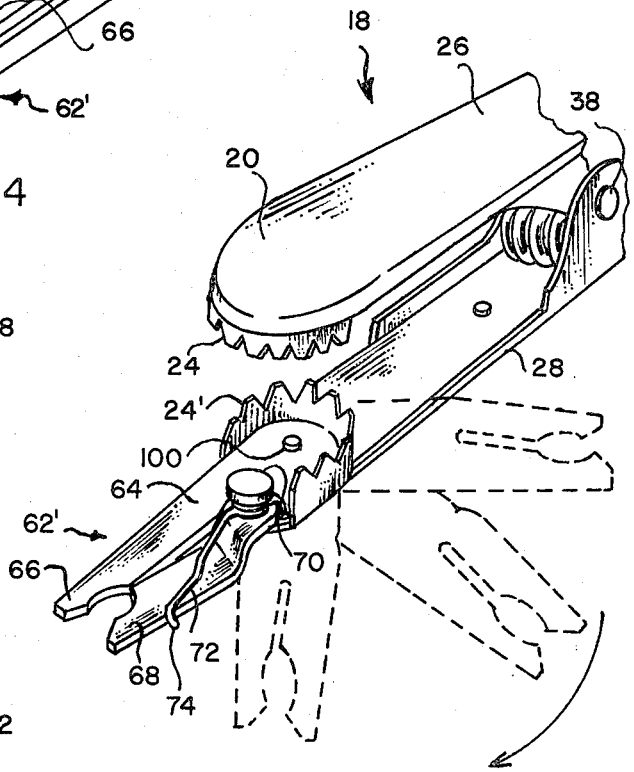
FIG. 5 is a perspective view of the embodiment of FIG. 4 showing a plurality of angles in which the adapter of FIG. 3 can be positioned and maintained.

In the condition shown in FIG. 4, auxiliary connector 18' is usable as a conventional auxiliary connector on a top terminal battery in the same manner as shown in FIG. 1 with jaw 22' opposing jaw 20 and gripping opposite sides of battery terminal 14 (FIG. 1).

A pivot 100 is disposed concentric to the semi-circular arc defined by the ends of adapter 62' and jaw 20. Adapter 62' may be rotated about pivot 100 to any angular position with respect to an axis of leg 28', as shown in FIG. 5. When a desired angle is selected for adapter 62', jaw 20 may be lowered so that the teeth of serrated surfaces 24 and 24' interengage and lock adapter 62' in any one of a number of preselectable angular positions shown in dashed lines in FIG. 5.

In order to retain adapter 62' in the angular position of FIG. 4 for use as a conventional top terminal auxiliary connector, a retaining pin 102 may be provided in lower leg 28'. Retaining pin 102 prevents the rotation of adapter 62' from the position of FIG. 4 to any of the positions in FIG. 5 without the exertion of considerable force to pass pivoted clamp half 68 over retaining pin 102.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An adapter for connecting an auxiliary cable to a side terminal of a side terminal battery, said side terminal having a head portion with a circumferential groove therein, said adapter comprising:

a metallic member comprising two separate clamp halves;

a first clamp half;

a first inner contour on said first clamp half having a shape and thickness adapted for fitting within a first portion of said circumferential groove at a first side of said side terminal;

a second clamp half disposed opposed to said first clamp half;

a second inner contour on said second clamp half opposed to said first inner contour and having a shape and thickness adapted for fitting within a second portion of said circumferential groove at a second side of said side terminal which is substantially opposite said first side;

means for pivoting said second clamp half to permit motion of said second inner contour toward and away from said first inner contour;

resilient means for urging said second clamp half about said means for pivoting toward said first clamp half;

at least one camming surface on an outer end of at least said second clamp half, said camming surface being adapted for contacting said circumferential groove and for pivoting said second inner contour away from said first inner contour when said camming surface is pressed onto said circumferential groove whereby said first and second inner contours are opened to a dimension sufficient for entry of said circumferential groove therebetween;

said resilient means being effective to clamp said first and second inner contours in said circumferential groove about said side terminal whereby mechanical and electrical connection between said adapter and said side terminal is achieved; and means for mechanically and electrically connecting said auxiliary cable to said adapter whereby mechanical and electrical connection between said side terminal and said auxiliary cable is achieved through said adapter.

2. An adapter according to claim 1 wherein said means for mechanically and electrically connecting includes an end of said metallic member which extends away from said first and second clamp halves to permit clamping thereupon of an auxiliary connector of said auxiliary cable.

3. An adapter according to claim 2 wherein said end extends substantially coplanar with said first and second clamp halves.

4. An adapter according to claim 2 wherein said end extends at an angle to a plane of said first and second clamp halves.

5. An adapter according to claim 1 wherein said means for mechanically and electrically connecting includes an auxiliary connector connected to said auxiliary cable and means for pivotably connecting said adapter to said auxiliary connector.

6. An adapter according to claim 1 wherein said metallic member and said first clamp half are substantially coplanar, an upper portion of said second clamp half disposed face to face with a surface of said metallic member, said means for pivoting being disposed in said upper portion, and a bend in said second clamp half effective to displace a lower portion of said second clamp half containing said second inner contour coplanar with said metallic member and said first clamp half.

7. An auxiliary connector for connecting an auxiliary cable to a battery terminal comprising:

first and second mutually pivoted member having first and second opposed jaws at a first end of each thereof;

said auxiliary cable being attached to a second end of one of said mutually pivoted members;

said first and second jaws having first and second sets of opposed teeth respectively thereon;

said first set of teeth being disposed along a portion of a first circle;

said second jaw including an adapter;

said adapter including said second set of teeth disposed along a portion of a second circle;

means for pivoting said adapter about a center of said second circle;

said first and second sets of teeth being adapted for mutual interengagement therebetween at a plurality of rotational positions of said adapter about said center of said second circle, whereby said adapter may be locked into a selectable one of said plurality of rotational positions;

a metallic plate member on said adapter;

a first clamp half affixed to an end of said plate member remote from said second set of teeth;

a second clamp half opposed to said first clamp half;

means for pivoting a first end of said second clamp half to said plate member;

resilient means for urging a second end of said second clamp half toward said first clamp half;

a first inner contour on said first clamp half facing said second clamp half;

a second inner contour on said second clamp half facing said first clamp half and opposed to said first inner contour;

a camming surface on said second clamp half effective to rotate said second end of said second clamp half away from said first clamp half when said camming surface is pressed against a battery terminal of the side terminal type whereby said first and second clamp halves are opened to admit said side terminal between said first and second inner contours for gripping thereof when said adapter is in at least one of said plurality of rotational positions; and said first and second sets of teeth on said first and second jaws respectively being effective to grip opposed sides of a battery terminal of the top terminal type when said adapter is in at least a second of said plurality of rotational positions.

* * * * *